US009828569B2

(12) United States Patent
Mort, III et al.

(10) Patent No.: US 9,828,569 B2
(45) Date of Patent: Nov. 28, 2017

(54) GRANULAR LAUNDRY DETERGENT

(71) Applicant: The Procter & Gamble Company, Cincinnati, OH (US)

(72) Inventors: Paul R. Mort, III, Beijing (CN); Hong Sing Tan, Beijing (CN); Rui Shen, Beijing (CN); Daitao Geng, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 197 days.

(21) Appl. No.: 14/303,685

(22) Filed: Jun. 13, 2014

(65) Prior Publication Data

US 2014/0366281 A1 Dec. 18, 2014

(30) Foreign Application Priority Data

Jun. 13, 2013 (WO) ..... PCT/CN2013/077157
Jan. 27, 2014 (WO) ..... PCT/CN2014/071532

(51) Int. Cl.

| | |
|---|---|
| ***C11D 3/12*** | (2006.01) |
| ***C11D 3/10*** | (2006.01) |
| ***C11D 17/06*** | (2006.01) |
| ***C11D 1/29*** | (2006.01) |
| ***C11D 1/37*** | (2006.01) |
| ***D06L 1/00*** | (2017.01) |
| *C11D 1/22* | (2006.01) |

(52) U.S. Cl.

CPC ..... *C11D 1/29* (2013.01); *C11D 1/37* (2013.01); *C11D 3/124* (2013.01); *C11D 17/065* (2013.01); *C11D 1/22* (2013.01)

(58) Field of Classification Search

None

See application file for complete search history.

(56) References Cited

U.S. PATENT DOCUMENTS

| | | | |
|---|---|---|---|
| 3,886,079 | A | 5/1975 | Burke, Jr. |
| 6,051,544 | A | 4/2000 | Lang et al. |
| 6,159,927 | A | 12/2000 | Kandasamy |
| 6,369,020 | B1 | 4/2002 | Kohlus et al. |
| 2011/0177993 | A1 | 7/2011 | Mort, III et al. |

FOREIGN PATENT DOCUMENTS

| | | | |
|---|---|---|---|
| EP | 0 430 603 | A2 | 6/1991 |
| EP | 2245133 | B1 | 11/2010 |
| EP | 2252678 | B1 | 12/2011 |
| WO | WO 98/04670 | A1 | 2/1998 |
| WO | WO 02/053691 | A1 | 7/2002 |
| WO | WO 2006/088666 | A1 | 8/2006 |
| WO | WO 2010/117925 | A1 | 10/2010 |
| WO | WO 2011/109319 | A1 | 9/2011 |

OTHER PUBLICATIONS

International Search Report; International Application No. PCT/CN2014/071532; dated May 12, 2014; 3 pages.

*Primary Examiner* — Lorna Douyon

(74) *Attorney, Agent, or Firm* — John T. Dipre; Steven W. Miller

(57) ABSTRACT

This relates to granular laundry detergent products characterized by efficient mass and volume compaction, fast dissolution or dispersion and enhanced suds profile, which are particularly useful for hand-washing fabric under suboptimal washing conditions.

12 Claims, 1 Drawing Sheet

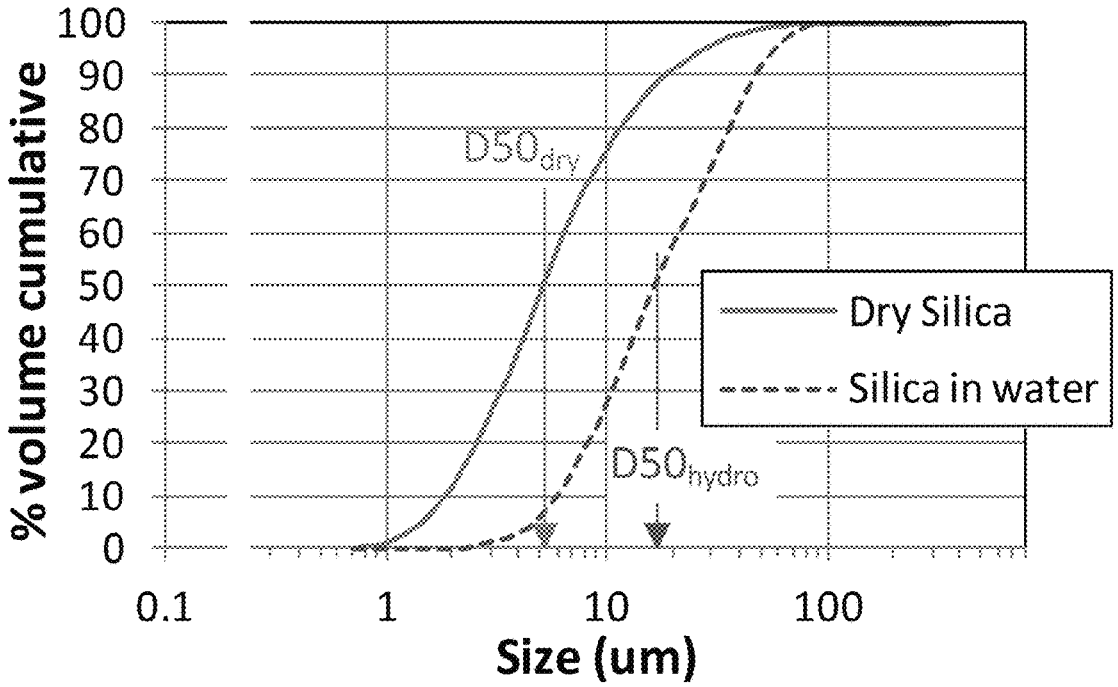
100
90
80
70
60
50
40
30
20
10
0
% volume cumulative
D50dry
D50hydro
Dry Silica
Silica in water
0.1
1
10
100
Size (um)

GRANULAR LAUNDRY DETERGENT

FIELD OF THE INVENTION

The present invention relates to fabric cleaning compositions. Particularly, it relates to granular laundry detergent products characterized by efficient mass and volume compaction, fast dissolution or dispersion, and enhanced suds profile.

BACKGROUND OF THE INVENTION

Granular laundry detergent compositions of today may contain detergent granules formed either by agglomeration process or by spray drying process. The agglomeration process can produce detergent granules with higher bulk density and higher concentrations of cleaning actives or surfactants than typical detergent granules that are formed by the spray drying process. Such high density, high active detergent granules are particularly useful for forming laundry detergents that are more compacted in size with smaller mass and volume, which directly translate into end benefits such as environmental friendliness, more cost-effective packaging and shipping, and improved efficiency of the product's commercial supply chain. Further, the agglomeration process has a significantly lower carbon footprint in comparison with the spray drying process and is therefore particularly desirable for making laundry detergent products of long term environment sustainability.

However, the high density, high active agglomerated detergent granules have been known to suffer from slow dissolution in water. The slower dissolution of such agglomerated detergent granules makes them particularly unsuitable for suboptimal washing conditions, such as, for example, hand-washing conditions where the water temperature is relatively lower, the amount of water used for washing is relatively smaller, and the washing cycle is relatively shorter, in comparison with machine washing conditions.

Despite the fast growing population of washing machine users, hand-washing fabric is still a prevalent laundering practice in a majority of the developing countries in the world, and there is therefore a continuing need for high density, high active detergent granules with improved dissolution profile suitable for forming laundry detergent products that are suitable for suboptimal washing conditions.

Further, consumers who hand-wash fabric view copious suds in the wash as the primary and most desirable signal of cleaning. High suds volume is especially desirable during hand washing of fabrics, since the consumer can directly feel and touch the suds generated during the wash cycle and intuitively correlates the high suds volume with the achievement of sufficient fabric cleaning. However, it is costly to add more surfactant into the detergent composition in order to generate a consumer-delighting amount of suds during the wash, and additional surfactant renders the detergent composition harsh to the consumer's hands and also requires a larger amount of water to rinse off during the rinse cycle, which can be a limitation for regions where water is scarce. Therefore, there is also a need for detergent compositions capable of generating more suds during the wash, but without increasing the surfactant level therein.

SUMMARY OF THE INVENTION

The present invention relates to a granular detergent composition that contains from 1% to 99% by total weight of the composition of structured particles containing: (1) from 35% to 80% of an anionic surfactant by total weight of the structured particles; and (2) from 8% to 50% of a hydrophilic silica by total weight of the structured particles. Such structured particles are characterized by a particle size distribution Dw50 ranging from 250 μm to 1000 μm and a bulk density ranging from 500 to 1000 g/L. The anionic surfactant is preferably, but not necessarily, a $C_{10}$-$C_{20}$ linear or branched alkylethoxy sulfate or salt thereof having an average degree of ethoxylation ranging from 0.1 to 5.0. The hydrophilic silica comprises less than 10% residual salt by total weight of the silica and is capable of forming upon hydration swollen silica particles having a particle size distribution Dv50 of from 1 μm to 100 μm.

The present invention also relates to a method of using such granular detergent composition for hand-washing fabric.

These and other aspects of the present invention will become more apparent upon reading the following drawings and detailed description of the invention.

BRIEF DESCRIPTION OF THE DRAWINGS

FIG. 1 shows the cumulative volume particle size distribution (PSD) curves of a hydrophilic precipitated silica in a dry state and a hydrated state.

DETAILED DESCRIPTION OF THE INVENTION

As used herein, articles such as "a" and "an" when used in a claim, are understood to mean one or more of what is claimed or described. The terms "include", "includes" and "including" are meant to be non-limiting.

As used herein, the term "a granular detergent composition" refers to a solid composition, such as granular or powder-form all-purpose or heavy-duty washing agents for fabric, as well as cleaning auxiliaries such as bleach, rinse aids, additives, or pre-treat types.

The term "structured particle" as used herein refers to a particle comprising a hydrophilic silica and a cleaning active, preferably a structured agglomerate.

The term "bulk density" as used herein refers to the uncompressed, untapped powder bulk density, as measured by the Bulk Density Test specified hereinafter.

The term "particle size distribution" as used herein refers to a list of values or a mathematical function that defines the relative amount, typically by mass or weight, of particles present according to size, as measured by the Sieve Test specified hereinafter.

The term "residual salt" as used herein refers to salts formed during the silica manufacturing process, for example as by-products of silica precipitation.

The term "Suds Boosting Factor" as used herein refers to the percentage (%) enhancement in the suds profile measured for a granular detergent composition of the present invention relative to that measured for a control granular detergent composition that does not contain the structured particles of the current invention.

The term "Dissolution Residue Value" as used herein refers to the percentage (%) residue left on a sieve after a standard amount of a raw material, e.g., a granular detergent composition, is mixed with water and then filtered through the sieve, according to the Dissolution Residue Test described hereinafter.

As used herein, the term "substantially free" means that that the component of interest is present in an amount less than 0.1% by weight.

As used herein, the term "Swollen Factor" refers to the ratio of the total volume of a raw material, e.g., a hydrophilic silica, before it is subject to hydration relative to the total volume of the same raw material after it has been fully hydrated, according to the Swollen Factor Test described hereinafter.

As used therein, the term "water-swellable" refers to the capability of a raw material to increase volumetrically upon hydration.

In all embodiments of the present invention, all percentages or ratios are calculated by weight, unless specifically stated otherwise. The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Structured Particles

The present invention relates to a structured particle that comprises from 35% to 80% of an anionic surfactant and from 8% to 50% of hydrophilic silica, by total weight of the structured particles. Such structured particle is particularly characterized by a particle size distribution Dw50 of from 250 μm to 1000 μm and a bulk density ranging from 500 to 1000 g/L, while the hydrophilic silica comprises less than 10% residual salt by total weight of the silica and is capable of forming upon hydration swollen silica particles that are characterized by a particle size distribution Dv50 of from 1 μm to 100 μm.

Without being bound by any theory, it is believed that hydrophilic silica in the structured particles of the current invention, when mixed with water (e.g., in a washing process), first imbibe water to undergo substantial volumetric expansion to form swollen silica particles, which speeds up disintegration of the structured particles and leads to faster dispersion and dissolution of the anionic surfactant into the washing liquor. The swollen silica particles then disintegrate into smaller, soft hydrogel microparticles in the presence of surrounding anionic surfactant upon rubbing or agitation during the wash cycle. Such soft hydrogel microparticles are believed to fill interstices between suds, and because the silica is hydrophilic, such microparticles are effective in holding water between suds to prevent water drainage, which function to sustain/stabilize suds that have already been generated and thereby boost suds volume during the wash cycle.

Therefore, such structured particles are particularly useful for forming high active and high density granular detergent compositions of enhanced suds profile and better dissolution or dispersion. Preferably, granular detergent compositions of the present invention are characterized by a Suds Boosting Factor of at least 15%, preferably at least 20%, and more preferably at least 30%. The granular detergent compositions can further be characterized by a Dispersion Residue Value of less than 10%, preferably less than 5%, and more preferably less than 2%.

Such granular detergent compositions are particularly suitable for hand-washing fabric, because the above-described benefits of increased suds volume and faster dissolution/dispersion are most evident to consumers during hand-washing process.

The structured particles of the present invention have a particle size distribution particularly Dw50 of from 250 μm to 1000 μm, preferably from 300 μm to 800 μm, more preferably from 400 μm to 600 μm. The bulk density of such structured particles may range from 500 g/L to 1000 g/L, preferably from 600 g/L to 900 g/L, more preferably from 700 g/L to 800 g/L.

Such structured particles may contain only one type of anionic surfactant. It may also contain a combination of two or more different anionic surfactants, a combination of one or more anionic surfactants with one or more nonionic surfactants, a combination of one or more anionic surfactants with one or more cationic surfactants, or a combination of all three types of surfactants (i.e., anionic, nonionic, and cationic).

Anionic surfactants suitable for forming the structured particles of the present invention can be readily selected from the group consisting of $C_{10}$-$C_{20}$ linear or branched alkyl alkoxylated sulphates, $C_{10}$-$C_{20}$ linear or branched alkyl benzene sulphonates, $C_{10}$-$C_{20}$ linear or branched alkyl sulfates, $C_{10}$-$C_{20}$ linear or branched alkyl sulphonates, $C_{10}$-$C_{20}$ linear or branched alkyl phosphates, $C_{10}$-$C_{20}$ linear or branched alkyl phosphonates, $C_{10}$-$C_{20}$ linear or branched alkyl carboxylates, and salts and mixtures thereof. The total amount of anionic surfactants in the structured particles may range from 35% to 80%, preferably from 40% to 70%, more preferably from 45% to 65%, and most preferably from 50% to 60%, by total weight of the structured particles.

In a preferred, but not necessary, embodiment of the present invention, the structured particles comprise an alkylalkoxysulfate-type anionic surfactant, preferably an alkylethoxysulfate (AES), wherein the average degree of alkoxylation, preferably ethyoxylation, is in the range of about 0.1 to 5.0, preferably from about 0.5 to 3.0, and more preferably from 1 to 2.

Other suitable anionic surfactants as described hereinabove can also be used for forming structured particles of the present invention, either independent of or in combination with AES. Especially suitable are $C_{10}$-$C_{20}$ linear or branched alkyl benzene sulphonates or salts thereof, preferably sodium salts of $C_{10}$-$C_{20}$ alkyl benzene sulphonates in straight chain configuration, and more preferably sodium salts of linear alkyl benzene sulphonates (LAS), in which the alkyl group contains from about 11 to about 13 carbon atoms. In a specific embodiment of the present invention, the structured particles of the present invention comprise both AES and LAS, with LAS present in an amount ranging from about 1% to 40%, preferably from 5% to 30%, more preferably from 10% to 20% by totally weight of the structured particles.

Nonionic and/or cationic surfactants can also be used in addition to anionic surfactant in forming the structured particles of the present invention. Suitable nonionic surfactants are selected from the group consisting of $C_8$-$C_{18}$ alkyl alkoxylated alcohols having an average degree of alkoxylation from 1 to 20, preferably from 3 to 10, and most preferred are $C_{12}$-$C_{18}$ alkyl ethoxylated alcohols having an average degree of alkoxylation of from 3 to 10; and mixtures thereof. Suitable cationic surfactants are mono-$C_{6-18}$ alkyl mono-hydroxyethyl di-methyl quaternary ammonium chlorides, more preferred are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Hydrophilic silica is incorporated into the structured particles of the present invention, which upon hydration can interact with the anionic surfactant to form swollen hydrogel particles of significantly larger sizes, thereby facilitating faster dispersion and dissolution of the surfactant into the laundering liquor. Further, the swollen silica hydrogel particles upon further rubbing and agitation during the wash cycle may form soft hydrogel microparticles with appropriate size and surface property that are particularly advantageous for sustaining/stabilizing suds already generated, resulting in higher suds volume during the wash cycle.

The hydrophilic silica is preferably present in the structured particles in an amount ranging from 8% to 50%, more preferably from 9% to 40% or 10% to 30%, and most preferably from 12% to 25% by total weight of the structured particles.

The hydrophilic silica powder raw material used herein has relatively small dry particle size and low residue salt content. Specifically, the silica particles have a dry particle size distribution Dv50 ranging from about 0.1 μm to about 100 μm, preferably from about 1 μm to about 40 μm, more preferably from about 2 μm to about 20 μm, and most preferably from 4 μm to about 10 μm. The residual salt content in the hydrophilic silica is less than 10%, preferably less than 5%, more preferably less than 2% or 1% by total weight of said silica. In a most preferred embodiment, the hydrophilic silica is substantially free of any residue salt.

Amorphous synthetic silica can be manufactured using a thermal or pyrogenic or a wet process. The thermal process leads to fumed silica. The wet process to either precipitated silica or silica gels. Either fumed silica or precipitated silica can be used for practice of the present invention. The pH of the hydrophilic silica of the present invention is normally from about 5.5 to about 9.5, preferably from about 6.0 to about 7.0. Surface area of the hydrophilic silica may range preferably from 100 to 500 $m^2/g$, more preferably from 125 to 300 $m^2/g$ and most preferably from 150 to 200 $m^2/g$, as measured by the BET nitrogen adsorption method.

Silica has both internal and external surface area, which allows for easy absorption of liquids. Hydrophilic silica is especially effective at adsorbing water. Swelling of dried hydrophilic silica upon contact with excess water to form hydrogel particles can be observed by optical microscopy and can be measured quantitatively using particle size analysis by comparing the particle size distribution of the fully hydrated material (i.e., in a dilute suspension) with that of the dried powder. Generally, precipitated hydrophilic silica can absorb water in excess of 2 times of its original weight, thereby forming swollen hydrogel particles having a Swollen Factor of at least 5, preferably at least 10, and more preferably at least 30. Therefore, the hydrophilic silica used in the present invention is preferably amorphous precipitated silica. A particularly preferred hydrophilic precipitated silica material for practice of the present invention is commercially available from Evonik Corporation under the tradename Sipernat® 340.

In order to allow the silica particles to achieve maximum volumetric expansion upon hydration, it is preferred that the structured particles of the present invention contain little or no free water, e.g., preferably less than 5%, more preferably less than 4% and most preferably less than 3% by total weight of such structured particles. In this manner, the external and internal surfaces of the silica particles are substantially free of water or liquids, and the silica particles are in a substantially dry state and are therefore capable of undergoing subsequent expansion in volume when they come into contact with water during washing cycle to facilitate disintegration of the structured particles and accelerate release of surfactant and/or other cleaning actives into water.

Upon hydration, i.e., when the structured particles of the present invention come into contact with water or other laundry liquor during a washing cycle, the hydrophilic silica as described hereinabove swells up significantly in volume to form swollen silica particles, which are characterized by a particle size distribution Dv50 of from 1 μm to 100 μm, preferably from 5 μm to 80 μm, more preferably from 10 μm to 40 μm, and most preferably from 15 μm to 30 μm. More specifically, the swollen silica particles formed by the hydrophilic silica upon hydration are characterized by a particle size distribution of Dv10 ranging from 1 μm to 30 μm, preferably from 2 μm to 15 μm, and more preferably from 4 μm to 10 μm; and Dv90 ranging from 20 μm to 100 μm, preferably from 30 μm to 80 μm, and more preferably from 40 μm to 60 μm.

In addition to surfactants and hydrophilic silica, the structured particles may also comprise one or more carbonate and/or sulfate salts, preferably alkaline metal carbonates and/or sulfates such as sodium carbonate, potassium carbonate, sodium bicarbonate, potassium bicarbonate, sodium sulfate, potassium sulfate, and the like. The amount of carbonate and/or sulfate salts in the structured particles may range from 5% to 60%, and preferably from 20% to 40%. Optionally, particle size of the salt(s) may be reduced by a milling, grinding or a comminuting step with any apparatus known in the art for milling, grinding or comminuting of granular or particulate compositions. In a particularly preferred embodiment of the present invention, the structured particles comprise sodium carbonate in an amount ranging from about 20% to 40%.

The structured particles of the present invention may comprise other cleaning actives, such as chelants, polymers, enzymes, bleaching agents, and the like.

Granular Detergent Composition

The above-described structured particles are particularly useful for forming high active and high density granular detergent compositions of improved suds profile and better dissolution or dispersion. Such structured particles may be provided in a granular detergent composition in an amount ranging from 1% to 99%, preferably from 2% to 80%, and more preferably from 3% to 50% by total weight of the granular detergent composition.

The granular detergent composition may comprise one or more additional surfactants that are added directly therein, i.e., independent of the structured particles. The additional surfactants can be same as those already included in the structured particles, or they can be different. The same types of anionic surfactants, non-ionic surfactants and cationic surfactants as described hereinabove for the structured particles are also suitable for directly addition into the granular detergent composition. In a preferred but not necessary embodiment of the present invention, the granular detergent composition comprises from 1% to 5% of the structured particles as described hereinabove in combination with from 10% to 20% independently added LAS, and optionally with one or more additional anionic surfactant and/or nonionic surfactant in the amount ranging from about 0.1% to 2%.

The granular detergent compositions of the present invention may further comprise a water-swellable cellulose derivative. Suitable examples of water-swellable cellulose derivatives are selected from the group consisting of substituted or unsubstituted alkyl celluloses and salts thereof, such as ethylcellulose, hydroxyethyl cellulose, hydroxypropyl methyl cellulose, methyl cellulose, carboxyl methyl cellulose (CMC), cross-linked CMC, modified CMC, and mixtures thereof. Preferably, such cellulose derivative materials can rapidly swells up within 10 minutes, preferably within 5 minutes, more preferably within 2 minutes, even more preferably within 1 minute, and most preferably within 10 seconds, after contact with water. The water-swellable cellulose derivatives can be incorporated into the structured particles of the present invention together with the hydrophilic silica, or they can be incorporated into the granular detergent compositions independent of the structured particles, in an amount ranging from 0.1% to 5% and preferably from 0.5% to 3%. Such cellulose derivatives may further enhance the hand feel of the granular detergent compositions of the present invention.

The granular detergent compositions may optionally include one or more other detergent adjunct materials for assisting or enhancing cleaning performance, treatment of the substrate to be cleaned, or to modify the aesthetics of the detergent composition. Illustrative examples of such detergent adjunct materials include: (1) inorganic and/or organic builders, such as carbonates (including bicarbonates and sesquicarbonates), sulphates, phosphates (exemplified by the tripolyphosphates, pyrophosphates, and glassy polymeric meta-phosphates), phosphonates, phytic acid, silicates, zeolite, citrates, polycarboxylates and salts thereof (such as mellitic acid, succinic acid, oxydisuccinic acid, polymaleic acid, benzene 1,3,5-tricarboxylic acid, carboxymethyloxysuccinic acid, and soluble salts thereof), ether hydroxypolycarboxylates, copolymers of maleic anhydride with ethylene or vinyl methyl ether, 1,3,5-trihydroxy benzene-2,4,6-trisulphonic acid, 3,3-dicarboxy-4-oxa-1,6-hexanedioates, polyacetic acids (such as ethylenediamine tetraacetic acid and nitrilotriacetic acid) and salts thereof, fatty acids (such as $C_{12}$-$C_{18}$ monocarboxylic acids); (2) chelating agents, such as iron and/or manganese-chelating agents selected from the group consisting of amino carboxylates, amino phosphonates, polyfunctionally-substituted aromatic chelating agents and mixtures therein; (3) clay soil removal/anti-redeposition agents, such as water-soluble ethoxylated amines (particularly ethoxylated tetraethylenepentamine); (4) polymeric dispersing agents, such as polymeric polycarboxylates and polyethylene glycols, acrylic/maleic-based copolymers and water-soluble salts thereof of, hydroxypropylacrylate, maleic/acrylic/vinyl alcohol terpolymers, polyethylene glycol (PEG), polyaspartates and polyglutamates; (5) optical brighteners, which include but are not limited to derivatives of stilbene, pyrazoline, coumarin, carboxylic acid, methinecyanines, dibenzothiphene-5,5-dioxide, azoles, 5- and 6-membered-ring heterocycles, and the like; (6) suds suppressors, such as monocarboxylic fatty acids and soluble salts thereof, high molecular weight hydrocarbons (e.g., paraffins, haloparaffins, fatty acid esters, fatty acid esters of monovalent alcohols, aliphatic $C_{18}$-$C_{40}$ ketones, etc.), N-alkylated amino triazines, propylene oxide, monostearyl phosphates, silicones or derivatives thereof, secondary alcohols (e.g., 2-alkyl alkanols) and mixtures of such alcohols with silicone oils; (7) suds boosters, such as $C_{10}$-$C_{16}$ alkanolamides, $C_{10}$-$C_{14}$ monoethanol and diethanol amides, high sudsing surfactants (e.g., amine oxides, betaines and sultaines), and soluble magnesium salts (e.g., $MgCl_2$, $MgSO_4$, and the like); (8) fabric softeners, such as smectite clays, amine softeners and cationic softeners; (9) dye transfer inhibiting agents, such as polyvinyl pyrrolidone polymers, polyamine N-oxide polymers, copolymers of N-vinylpyrrolidone and N-vinylimidazole, manganese phthalocyanine, peroxidases, and mixtures thereof; (10) enzymes, such as proteases, amylases, lipases, cellulases, and peroxidases, and mixtures thereof; (11) enzyme stabilizers, which include water-soluble sources of calcium and/or magnesium ions, boric acid or borates (such as boric oxide, borax and other alkali metal borates); (12) bleaching agents, such as percarbonates (e.g., sodium carbonate peroxyhydrate, sodium pyrophosphate peroxyhydrate, urea peroxyhydrate, and sodium peroxide), persulfates, perborates, magnesium monoperoxyphthalate hexahydrate, the magnesium salt of metachloro perbenzoic acid, 4-nonylamino-4-oxoperoxybutyric acid and diperoxydodecanedioic acid, 6-nonylamino-6-oxoperoxycaproic acid, and photoactivated bleaching agents (e.g., sulfonated zinc and/or aluminum phthalocyanines); (13) bleach activators, such as nonanoyloxybenzene sulfonate (NOBS), tetraacetyl ethylene diamine (TAED), amido-derived bleach activators including (6-octanamidocaproyl)oxybenzenesulfonate, (6-nonanamidocaproyl)oxybenzenesulfonate, (6-decanamidocaproyl) oxybenzenesulfonate, and mixtures thereof, benzoxazin-type activators, acyl lactam activators (especially acyl caprolactams and acyl valerolactams); and (9) any other known detergent adjunct ingredients, including but not limited to carriers, hydrotropes, processing aids, dyes or pigments, and solid fillers.

Process for Making Structured Particles

The process of making the structured particles of the present invention, preferably in an agglomerated form, comprising the steps of: (a) adding powder and/or paste forms of raw ingredients into a mixer wherein the raw ingredients comprises: the anionic surfactant(s), preferably in the form of a neutralized aqueous paste; the hydrophilic silica preferably in a fine powder form; and optionally, recycle fines and/or ground-oversize materials from a previous granulation process; (b) running the mixer to provide a suitable shear force for agglomeration of the raw ingredients; (c) optionally, removing any oversize lumps and recycling via a grinder or lump-breaker to step (a) or (b); (d) the resulting agglomerates are dried to remove moisture that may be present in excess of 5 wt %, preferably in excess of 4%, more preferably in excess of 3%, and most preferably in excess of 2 wt %; (e) optionally, removing any fines and recycling the fines to the mixer-granulator, as described in step (a); and (f) optionally, further removing any dried oversize agglomerates and recycling via a grinder to step (a) or (e).

Any suitable mixing apparatus capable of handling viscous paste can be used as the mixer described hereinabove for practice of the present invention. Suitable apparatus includes, for example, high-speed pin mixers, ploughshare mixers, paddle mixers, twin-screw extruders, Teledyne compounders, etc. The mixing process can either be carried out intermittently in batches or continuously.

Process for Making the Granular Detergent Compositions Comprising the Structured Particles The granular detergent composition, which is provided in a finished product form, can be made by mixing the structured particles of the present invention with a plurality of other particles containing the above-described additional surfactants, cellulose derivatives, and detergent adjunct materials. Such other particles can be provided as spray-dried particles, agglomerated particles, and extruded particles. Further, the additional surfactants, cellulose derivatives, and detergent adjunct materials can also be incorporated into the granular detergent composition in liquid form through a spray-on process.

Process for Using the Granular Detergent Compositions for Hand-Washing Fabric

The granular detergent compositions of the present invention is particular suitable for use in a hand-washing context. For hand-washing, the laundry detergent is typically diluted by a factor of from about 1:100 to about 1:1000, or about 1:200 to about 1:500 by weight, by placing the laundry detergent in a container along with wash water to form a laundry liquor. The wash water used to form the laundry liquor is typically whatever water is easily available, such as tap water, river water, well water, etc. The temperature of the wash water may range from about 0° C. to about 40° C., preferably from about 5° C. to about 30° C., more preferably from 5° C. to 25° C., and most preferably from about 10° C. to 20° C., although higher temperatures may be used for soaking and/or pretreating.

The laundry detergent and wash water is usually agitated to evenly disperse and/or either partially or completely dissolve the detergent and thereby form a laundry liquor. Such agitation forms suds, typically voluminous and creamy suds. The dirty laundry is added to the laundry liquor and optionally soaked for a period of time. Such soaking in the laundry liquor may be overnight, or for from about 1 minute to about 12 hours, or from about 5 minutes to about 6 hours, or from about 10 minutes to about 2 hours. In a variation herein, the laundry is added to the container either before or after the wash water, and then the laundry detergent is added to the container, either before or after the wash water. The method herein optionally includes a pre-treating step where the user pre-treats the laundry with the laundry detergent to form pre-treated laundry. In such a pre-treating step, the laundry detergent may be added directly to the laundry to form the pre-treated laundry, which may then be optionally scrubbed, for example, with a brush, rubbed against a surface, or against itself before being added to the wash water and/or the laundry liquor. Where the pre-treated laundry is added to water, then the diluting step may occur as the laundry detergent from the pre-treated laundry mixes with the wash water to form the laundry liquor.

The laundry is then hand-washed by the user who may or may not use one or more hand-held washing devices, such as washboards, brushes, or rods. The actual hand-washing duration may range from 10 seconds to 30 minutes, preferably from 30 seconds to 20 minutes, more preferably from 1 minute to 15 minutes, and most preferably from 2 minutes to 10 minutes. Once the laundry is hand-washed, then the laundry may be wrung out and put aside while the laundry liquor is either used for additional laundry, poured out, etc. The rinse water is then added to form a rinse bath, and then it is common practice to agitate the laundry to remove the surfactant residue. The laundry may be soaked in the rinse water and then wrung out and put aside. The number of rinses when using the liquid laundry detergent herein is typically from about 1 to about 3, or from about 1 to about 2. In a particularly preferred embodiment of the present invention, the rinse is carried out in a single rinse step or cycle.

Test Methods

The following techniques must be used to determine the properties of the detergent granules and detergent compositions of the invention in order that the invention described and claimed herein may be fully understood.

Test 1: Bulk Density Test

The granular material bulk density is determined in accordance with Test Method B, Loose-fill Density of Granular Materials, contained in ASTM Standard E727-02, "Standard Test Methods for Determining Bulk Density of Granular Carriers and Granular Pesticides," approved Oct. 10, 2002.

Test 2: Sieve Test

This test method is used herein to determine the particle size distribution of the agglomerated detergent granule's of the present invention. The particle size distribution of the detergent granules and granular detergent compositions are measured by sieving the granules through a succession of sieves with gradually smaller dimensions. The weight of material retained on each sieve is then used to calculate a particle size distribution.

This test is conducted to determine the Median Particle Size of the subject particle using ASTM D 502-89, "Standard Test Method for Particle Size of Soaps and Other Detergents", approved May 26, 1989, with a further specification for sieve sizes used in the analysis. Following section 7, "Procedure using machine-sieving method," a nest of clean dry sieves containing U.S. Standard (ASTM E 11) sieves #8 (2360 μm), #12 (1700 μm), #16 (1180 μm), #20 (850 μm), #30 (600 μm), #40 (425 μm), #50 (300 μm), #70 (212 μm), and #100 (150 μm) is required. The prescribed Machine-Sieving Method is used with the above sieve nest. The detergent granule of interest is used as the sample. A suitable sieve-shaking machine can be obtained from W.S. Tyler Company of Mentor, Ohio, U.S.A. The data are plotted on a semi-log plot with the micron size opening of each sieve plotted against the logarithmic abscissa and the cumulative mass percent (Q3) plotted against the linear ordinate.

An example of the above data representation is given in ISO 9276-1:1998, "Representation of results of particle size analysis—Part 1: Graphical Representation", Figure A.4. The Median Weight Particle Size (Dw50) is defined as the abscissa value at the point where the cumulative weight percent is equal to 50 percent, and is calculated by a straight line interpolation between the data points directly above (a50) and below (b50) the 50% value using the following equation:

$$D_w50=10[\ \mathrm{Log}(D_{a50})-(\mathrm{Log}(D_{a50})-\mathrm{Log}(D_{b50}))*(Q_{a50}-50\%)/(Q_{a50}-Q_{b50})]$$

where $Q_{a50}$ and $Q_{b50}$ are the cumulative weight percentile values of the data immediately above and below the $50^{th}$ percentile, respectively; and $D_{a50}$ and $D_{b50}$ are the micron sieve size values corresponding to these data. In the event that the $50^{th}$ percentile value falls below the finest sieve size (150 μm) or above the coarsest sieve size (2360 μm), then additional sieves must be added to the nest following a geometric progression of not greater than 1.5, until the median falls between two measured sieve sizes.

Test 3: Dissolution Residue Test

The Dissolution Residue Test is used to measure the amount of insoluble residue left on a standard sieve by a raw material, e.g., a granular detergent composition of the present invention, after it has been dissolved in water, which is expressed as the percentage (%) of the residue left by total weight of the raw material. The principle of applicants' Residue test follows that of published International Standard ISO 3262-19:2000, Section 8, "Determination of residue on sieve". The method is adapted herein to suit the need of the present invention.

Obtain a standard sieve consisting of a metal frame and wire mesh made from stainless steel, having a mesh size of 45 μm (e.g., ASTM 325 mesh) and frame diameter of about 200 to 250 mm Obtain a 1000 mL laboratory beaker. Obtain a drying oven, capable of being maintained at about 105° C. (+/−2° C.). Obtain a suitable microbalance with precision to 0.01 g. Record the tare weight of the clean dry sieve.

Weigh out 20 g (+/−0.01 g) of the raw material to be tested, e.g., a granular detergent composition of the present invention, into the beaker, then add 400 g (+/−1 g) of distilled water at about 20° C. (+/−2° C.), to the beaker and stir to break-up and disperse any lumps, then continue stirring for 15 minutes (for non-limiting example using a suitable stir plate with magnetic stir bar) until a suspension or solution is formed. Gradually empty the contents of the beaker into the sieve such that no liquid overflows the rim. The liquid passing through the screen is not retained. Rinse the beaker with an additional 400 g of distilled water, and pour the rinse water through the screen. Place the screen into the drying oven and let it remain until water is evaporated. Weigh the sieve including the dried residue on the screen, then subtract the mass of the clean dry sieve to determine the mass of residue on the screen. The Dissolution Residue Factor is calculated as a percentage (%)=the residue weight/initial raw material weight×100%.

Test 4: Silica Particle Size and Swollen Factor Test

The Swollen Factor Test is used to measure swelling of hydrophilic silica on contact with excess water. As a measure of swelling, this method compares the measured particle size distribution of silica hydrated in excess water relative to the measured particle size distribution of the dry silica powder.

Obtain a representative dry powder sample of the silica raw material to be tested.

Measure the dry powder's particle size distribution in accordance with ISO 8130-13, "Coating powders—Part 13: Particle size analysis by laser diffraction." A suitable laser diffraction particle size analyzer with a dry-powder feeder can be obtained from Horiba Instruments Incorporated of Irvine, Calif., U.S.A.; Malvern Instruments Ltd of Worcestershire, UK; Sympatec GmbH of Clausthal-Zellerfeld, Germany; and Beckman-Coulter Incorporated of Fullerton, Calif., U.S.A. The results are expressed in accordance with ISO 9276-1:1998, "Representation of results of particle size analysis—Part 1: Graphical Representation", Figure A.4, "Cumulative distribution Q3 plotted on graph paper with a logarithmic abscissa." The Dv10 dry particle size (D10dry) is defined as the abscissa value at the point where the cumulative volumetric distribution (Q3) is equal to 10 percent; the Dv50 dry particle size (D50dry) is defined as the abscissa value at the point where the cumulative volumetric distribution (Q3) is equal to 50 percent; the Dv90 dry particle size (D90dry) is defined as the abscissa value at the point where the cumulative volumetric distribution (Q3) is equal to 90 percent.

Prepare a hydrated silica particle sample by weighing 0.05 g of the representative dry powder sample, and adding it into stirred beaker having 800 ml of deionized water. Using the resultant dispersion of silica hydrogel particles, measure the silica hydrogel's particle size distribution in accordance with ISO 13320-1, "Particle size analysis—Laser diffraction methods." Suitable laser diffraction particle size analyzers for measurement of the silica hydrogel particle size distribution can be obtained from Horiba Instruments Incorporated of Irvine, Calif., U.S.A.; Malvern Instruments Ltd of Worcestershire, UK; and Beckman-Coulter Incorporated of Fullerton, Calif., U.S.A. The results are expressed in accordance with ISO 9276-1:1998, "Representation of results of particle size analysis—Part 1: Graphical Representation", Figure A.4, "Cumulative distribution Q3 plotted on graph paper with a logarithmic abscissa." The Dv10 hydrogel particle size (D10hydro) is defined as the abscissa value at the point where the cumulative volume distribution (Q3) is equal to 10 percent; the Dv50 hydrogel particle size (D50hydro) is defined as the abscissa value at the point where the cumulative volume distribution (Q3) is equal to 50 percent; the Dv90 hydrogel particle size (D90hydro) is defined as the abscissa value at the point where the cumulative volume distribution (Q3) is equal to 90 percent.

The silica's Swollen Factor is calculated as follows:

$$\text{Swollen Factor}=0.2\times(D10_{hydro}/D10_{dry})^3+0.6\times(D50_{hydro}/D50_{dry})^3+0.2\times(D90_{hydro}/D90_{dry})^3$$

As an example, FIG. 1 shows the cumulative volume particle size distribution (PSD) curves of the Sipernat® 340 hydrophilic precipitated silica material that is commercially available from Evonik Corporation in a dry state and a hydrated state. The Dv particle sizes for this example are shown in Table I.

TABLE I

| | Particle size (um) | | |
|---|---|---|---|
| | D10 | D50 | D90 |
| Dry silica particles | 2.08 | 5.82 | 21.01 |
| Silica in water (hydrogel) | 6.75 | 18.57 | 53.7 |

The Swollen Factor for the exemplary silica material described hereinabove, as calculated using the data from Table I, is about 30.

EXAMPLES

Example 1: Comparative Test Showing Suds Profile Improvement

A first particulate sample containing structured particles within the scope of the present invention (hereinafter "the Inventive Example") is made by first agglomerating 161.18 grams of an aqueous solution of AE1S (78% active), 95.52 grams of a sodium carbonate, and 43.30 grams of a precipitated hydrophilic silica powder (commercialized by Evonik Industries AG under the trade name SN340) to form 300 grams of structured particles according to the present invention, then drying such structured particles. Such dried structured particles have an AE1S activity level of about 45 wt % and a silica content of about 14.65 wt %. Then 0.4 gram of such structured particle is taken to be mixed with 0.2 gram of sodium carbonate to form the first particulate sample of about 0.6 gram.

A second particulate sample containing only AE1S and carbonate without silica (hereinafter "the Comparative Example") is made by agglomerating 112.27 grams of the same aqueous solution of AE1S (78% active) and 187.73 grams of the same sodium carbonate to form about 300 grams of agglomerates, which are then dried. Subsequently, 0.6 gram of such dried agglomerates is taken to form the second particulate sample, which has a comparative particle size as the first particulate sample.

The final compositional breakdowns of the Inventive Example and the Comparative Example are tabulated as follows:

TABLE II

| | Inventive Example | Comparative Example |
|---|---|---|
| AE1S | 0.180 g | 0.180 g |
| Carbonate (Na) | 0.337 g | 0.386 g |
| Silica | 0.062 g | — |
| Water | 0.016 g | 0.025 g |
| Misc | 0.005 g | 0.009 g |
| Total | 0.600 g | 0.600 g |

The above-described two samples are then tested for their suds profile by using a SITA Foam Tester R2000 (commercially available from SITA Messtechnik GmbH Gostritzer Strasse 6301217 Dresden Germany). The revolution speed of the SITA Foam Test R2000 is set at 1000 RPM. Each sample is added into a test tube in the SITA Foam Test R2000 that has a diameter of 12 cm and contains 250 ml of deionized water, which is then spun at 1000 RPM. The suds volume so generated is measured at every 10 seconds until the 150 seconds. Each sample is tested three times, and the testing results of all three times are averaged and recorded as the final suds volume generated at a particular time point.

The suds volumes measured at 60 seconds, 70 seconds, 80 seconds and 90 seconds (which may reflect the period of time during hand wash when the consumer is likely to be delighted by ample suds) are recorded, and the suds profile of each sample is then calculated by averaging the suds volumes measured at these time points.

Following are the recorded suds volumes and the suds profile calculated for the above-described Inventive Example and Comparative Example:

TABLE III

| | Suds Volume (ml) | | | | Suds |
|---|---|---|---|---|---|
| | 60s | 70s | 80s | 90s | Profile (ml) |
| Inventive Example | 557 | 624 | 647 | 665 | 623 |
| (Standard deviation—SD) | (5) | (5) | (6) | (22) | |
| Comparative Example | 444 | 446 | 453 | 497 | 460 |
| (SD) | (3) | (11) | (14) | (3) | |

The Inventive Example containing the structured particles within the scope of the present invention has a better suds profile than the Comparative Example without such structured particles, which translates to a Suds Boosting Factor of about 35%.

Example 2: Process for Making a Structured Particle

A structured particle can be prepared according to the following preferred method:

1. Obtain a suitable cleaning active raw material, preferably a surfactant in the form of a concentrated aqueous paste. Suitable surfactant pastes are available from a variety of commercial sources including, for example: Shell Chemical LP, Houston, Tex., USA; Sasol O&S Products, Hamburg, Germany; Huntsman Chemical Company, Houston, Tex., USA; Sinopec Corp., Nanjing, China; preferred pastes have active levels in the range from about 70% to 78% surfactant. The cleaning active raw material acts as the binder for agglomeration in step 3.
2. Obtain a suitable hydrophilic silica powder. Suitable silica powders are commercially available from a number of suppliers, including, for example, Evonik Industries, Hanau, Germany; JM Huber Corporation, Edison, N.J., USA; Madhu Silica Ltd., Bhavnagar, India. Optionally, the silica powder's dry particle size may be further reduced by a milling, grinding or a comminuting step with any apparatus known in the art for milling, grinding or comminuting of granular or particulate compositions. The silica powder is the structurant for the structured particle.
3. Combine the above materials plus any other active or non-active materials, plus any recycle materials in a mixing chamber to make structured particles. The mixing process involves contacting the silica and other powders with the cleaning active raw material to achieve a substantially homogenous dispersion of the active with the powder. The mixing chamber may be any apparatus known in the art for agglomeration, granulation or mixing of particulate compositions. Examples of suitable mixer granulators include, but are not limited to, dual-axis counter-rotating paddle mixers, high-shear horizontal-axis mixer granulators, vertical-axis mixer-granulators, and V-blenders with intensifier elements. Such mixers may be batch or continuous in operation. In one aspect, the mixing chamber is a medium to high shear mixer with a primary impeller having a tip speed of 0.5 to 50 meters/second, 1 to 25 meters/second, 1.5 to 10 meters/second, or even 2 to 5 meters/second. In one aspect, the mixing chamber is a ploughshare mixer with a chopper located between the ploughs, wherein the binder is added adjacent to the chopper location. In another aspect, the mixing chamber is a dual-axis counter-rotating paddle mixer having binder ingress points in the bottom of the mixer, for example as described in U.S. Publication No. 2007/0196502, the cleaning active raw material being added upward into the converging flow zone between the counter-rotating paddle axes of the counter-rotating dual-axis paddle mixer.
4. The particles may be at least partially dried in a subsequent drying process. In one aspect, the drying process is a fluidized bed drier.
5. Optionally, classifying the particles of step 4 to obtain particles with an acceptable particle size distribution, where any oversize or undersize materials may optionally be recycled to process step 3 above. The classification may be done with any apparatus known in the art for particulate classification, separation, screening or elutriation of particulate compositions. Elutriation of fine particles may be done as an integral part of step 3, using a fluidized bed. In one aspect, any oversize material may reduced in particle size before recycling by milling, grinding or comminuting with any apparatus known in the art for milling, grinding or comminuting of granular or particulate compositions. In another aspect, the product granules may be treated by screening out oversized particles using equipment such as a vibratory screener.

The following table shows exemplary structured particle formulations 1A-1G according to the present invention.

TABLE IV

| Ingredients | 1A | 1B | 1C | 1D | 1E | 1F | 1G |
|---|---|---|---|---|---|---|---|
| NaAExS (x = 1 to 3) | 35% | 45% | 55% | 0% | 0% | 0% | 15% |
| NaLAS | 0% | 0% | 0% | 45% | 55% | 70% | 30% |
| Hydrophillic Silica | 11% | 16% | 19% | 11% | 17% | 23% | 14% |
| Sodium carbonate | 45% | 35% | 23% | 32% | 25% | 4% | 38% |
| CMC | 3% | 0% | 0% | 5% | 0% | 0% | 0% |
| Moisture & misc. | 6% | 4% | 3% | 7% | 3% | 3% | 3% |
| Total | 100% | 100% | 100% | 100% | 100% | 100% | 100% |

Table notes:
1A, 1B) 70% active NaAES paste binder
1C) 78% active NaAES paste binder
1D, 1E) 74% active NaLAS paste binder
1F) 78% active NaLAS paste binder
1G) a mixture of NaLAS and NaAES paste binders

Example 3: Granular Detergent Compositions

Exemplary granular detergent products, 2A-2O, made using the structured particles 1A-1G from Example 1, are shown in the following Table V. The base granule as described below is typically spray-dried or agglomerated; its composition may comprise LAS surfactant, detersive polymer, chelant, sodium silicate, sodium carbonate and sodium sulfate. The use of structured particles in product formulation may allow simplification of the base granule. The other admix ingredients as described below may comprise fillers and/or other functional cleaning actives such as bleach actives, brightener, enzyme, suds suppressor, hueing dye, perfume, aesthetic particles and/or miscellaneous ingredients.

TABLE V

| Product | Structured particles | Base Granule | Other Admix | Total |
|---|---|---|---|---|
| 2A | 1A: 4.3% & 1D: 19.8% | 53.0% | 23.0% | 100% |
| 2B | 1B: 3.3% | 73.7% | 23.0% | 100% |
| 2C | 1C: 2.7% & 1D: 19.8% | 54.5% | 23.0% | 100% |
| 2D | 1E: 14.4% & 1C: 2.7% | 59.9% | 23.0% | 100% |
| 2E | 1F: 11.3% & 1C: 2.7% | 63.0% | 23.0% | 100% |
| 2F | 1B: 6.2% | 65.0% | 28.8% | 100% |
| 2G | 1D: 19.8% | 65.3% | 15.0% | 100% |
| 2H | 1A: 3.1% & 1D: 19.8% | 40.2% | 37.0% | 100% |
| 2I | 1B: 2.4% & 1D: 19.8% | 40.9% | 37.0% | 100% |
| 2J | 1C: 2.0% & 1D: 19.8% | 41.3% | 37.0% | 100% |
| 2K | 1C: 2.0% & 1E: 14.4% | 46.7% | 37.0% | 100% |
| 2L | 1G: 7.3% | 55.7% | 37.0% | 100% |
| 2M | 1B: 3.3% & 1D: 19.8% | 56.0% | 21.0% | 100% |
| 2N | 1B: 2.1% & 1D: 19.8% | 61.1% | 17.0% | 100% |
| 2O | 1B: 2.1% | 80.9% | 17.0% | 100% |

The compositional breakdowns of the exemplary granular detergent products 2A-2O as described hereinabove are shown below in Table VI.

TABLE VI

| Ingredients | 2A-2E | 2F | 2G | 2H-2L | 2M | 2N-2O |
|---|---|---|---|---|---|---|
| LAS Surfactant | 14.2% | 13.1% | 15.6% | 12.4% | 14.6% | 14.0% |
| AES Surfactant | 1.5% | 2.8% | 0.0% | 1.1% | 1.5% | 1.0% |
| Other Surfactant | 0.9% | 1.2% | 0.0% | 1.7% | 0.9% | 1.0% |
| Polymer System | 2.2% | 2.1% | 1.4% | 3.9% | 1.7% | 1.1% |
| Sodium Carbonate | 18.0% | 19.1% | 12.6% | 23.7% | 17.4% | 13.6% |
| Sodium Silicate | 8.2% | 7.0% | 9.1% | 6.8% | 7.5% | 6.3% |
| Sodium Sulfate | 38.0% | 45.0% | 52.0% | 12.4% | 45.0% | 55.4% |
| Bleach System | 7.6% | 0.0% | 0.0% | 30.9% | 2.9% | 0.0% |
| Enzyme System | 0.8% | 0.4% | 0.3% | 0.8% | 0.7% | 0.5% |
| Other Actives, Silica, Misc. | 8.6% | 9.3% | 9.0% | 6.3% | 7.8% | 7.1% |
| Total | 100.0% | 100.0% | 100.0% | 100.0% | 100.0% | 100.0% |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A granular detergent composition comprising from 1% to 99% by total weight of said composition of structured particles that comprise:

(1) from 50% to 60% of an anionic surfactant by total weight of the structured particles;

(2) from 12% to 25% of a hydrophilic silica by total weight of the structured particles, and (3) from 20% to 40% of sodium carbonate by total weight of the structured particle, wherein the composition further comprises from 10% to 20% of an additional anionic surfactant by total weight of said composition and from 0.5% to 3% of a carboxy methyl cellulose by total weight of said composition, wherein said structured particles are characterized by a particle size distribution Dw50 ranging from 250 μm to 1000 μm and a bulk density ranging from 500 to 1000 g/L, wherein said anionic surfactant is a $C_{10}$-$C_{20}$ linear alkylethoxy sulfate or salt thereof having an average degree of ethoxylation ranging from 1 to 2, wherein said hydrophilic silica comprises less than 10% residual salt by total weight of the silica and is capable of forming swollen silica particles upon hydration, and wherein said swollen silica particles have a particle size distribution Dv50 of from 1 μm to 100 μm, wherein the additional anionic surfactant is a sodium salt of a $C_{10}$-$C_{20}$ linear alkyl benzene sulphonate.

2. The granular detergent composition of claim 1, wherein said granular detergent composition is a hand-washing laundry detergent composition.

3. The granular detergent composition of claim 1, wherein the hydrophilic silica is amorphous precipitated silica.

4. The granular detergent composition of claim 1, wherein the hydrophilic silica is substantially free of residual salt.

5. The granular detergent composition of claim 1, wherein the hydrophilic silica is characterized by a Swollen Factor of at least 30.

6. The granular detergent composition of claim 1, wherein the particle size distribution of the swollen silica particles formed by the hydrophilic silica upon hydration is characterized by Dv50 ranging from 15 μm to 30 μm.

7. The granular detergent composition of claim 1, wherein the particle size distribution of the swollen silica particles formed by the hydrophilic silica upon hydration is characterized by: (1) Dv10 ranging from 4 μm to 10 μm; and (2) Dv90 ranging from 40 μm to 60 μm.

8. The granular detergent composition of claim 1, characterized by a Suds Boosting Factor of at least 30%.

9. A method of using the granular detergent composition according to claim 1 for hand-washing fabric, comprising the steps of:

(a) providing the granular detergent composition;

(b) forming a laundry liquor by diluting the granular detergent composition with water at a weight ratio of from about 1:100 to 1:1000;

(c) hand-washing fabric in the laundry liquor; and (d) rinsing the fabric with water.

10. The method of claim 9, wherein step (c) is carried out with the laundry liquor temperature ranging from 0° C. to 40° C.

11. The method of claim 9, wherein step (c) is carried out for a duration ranging from 10 seconds to 30 minutes.

12. The method of claim 9, wherein step (d) is carried out by a single rinse cycle.

* * * * *